United States Patent [19]

Hosak-Robb

[11] Patent Number: 4,707,922

[45] Date of Patent: Nov. 24, 1987

[54] EATING IMPLEMENT

[75] Inventor: Barbara Hosak-Robb, Munich, Fed. Rep. of Germany

[73] Assignee: Robbe & Berking GmbH & Co. KG

[21] Appl. No.: 784,853

[22] Filed: Oct. 4, 1985

[30] Foreign Application Priority Data

Sep. 4, 1985 [DE] Fed. Rep. of Germany ... 8525202[U]

[51] Int. Cl.[4] ..... A47J 43/28

[52] U.S. Cl. ..... 30/322; 294/99.2

[58] Field of Search ..... 30/322; 294/99.2

[56] References Cited

U.S. PATENT DOCUMENTS

| | | | |
|---|---|---|---|
| 2,024,849 | 12/1935 | Eliopoulos | 294/99.2 |
| 2,411,825 | 11/1946 | Fergusen | 294/99.2 |
| 3,140,715 | 7/1964 | Whitton et al. | 294/99.2 X |
| 3,186,749 | 6/1965 | Dawes | 294/99.2 |
| 3,640,561 | 2/1972 | Law | 294/99.2 |
| 3,892,435 | 7/1975 | Huey | 294/99.2 |
| 4,009,899 | 3/1977 | Johnson | 294/99.2 |
| 4,452,106 | 6/1984 | Tartaglia | 294/99.2 |

FOREIGN PATENT DOCUMENTS

| | | | |
|---|---|---|---|
| 2063434 | 7/1981 | United Kingdom | 294/99.2 |

*Primary Examiner*—Douglas D. Watts

*Attorney, Agent, or Firm*—Toren, McGeady & Associates

[57] ABSTRACT

The eating implement comprises a tong-like shaped body with two rod-like members interconnected by means of a resilient-elastic web, said members having pointed ends, the tong members being curved in accordance with the curvature of the prongs of a fork and after pressing together automatically spring back into their initial position on removing the external pressure. Thus, an eating implement is obtained which, in the same way as oriental chopsticks, makes it possible to take up pieces of food and guide same to the mouth and which can also be used in the same way as a conventional fork.

8 Claims, 8 Drawing Figures

EATING IMPLEMENT

BACKGROUND OF THE INVENTION

Apart from conventional forks, with which pieces of food can be taken up and guided to the mouth, a Far Eastern eating implement is known, which comprises a pair of wooden, bone or ivory sticks. Very considerable dexterity is necessary to use these chopsticks and not everyone is able to provide this, so that often this aesthetic and elegant manner of eating with chopsticks is avoided.

SUMMARY OF THE INVENTION

The problem of the present invention is to provide an eating implement enabling pieces of food to be taken up and guided to the mouth in the same way as with Far Eastern chopsticks, without it requiring the oriental dexterity and which can also be used in the same way as the conventional fork.

According to the invention the above problem is solved by an eating implement, wherein the eating implement comprises a tong or tweezer-like shaped article with two long, rod-like, roughly parallel members interconnected by means of a web and whose ends taper to a point, the tong web being constructed as a resilient-elastic element which automatically returns to its prebent shape, which enables the pressing of the tong member towards one another and which after removing a pressure exerted on said tong members enables the same to spring back to their initial position.

With the aid of such a tong-like eating implement, pieces of food can be guided to the mouth, without there being any need for the oriental dexterity required for using chopsticks. Moreover, the eating implement can be used in the same way as a traditional fork. In both cases, this eating implement permits a very aesthetic and elegant manner of eating. By lightly pressing together the two long members of the eating implement, the piece of food taken up is held firmly between the tong member ends and in this way can be guided to the mouth. By removing the pressure exerted on the tong members of the eating implement, said members spring back into their initial position and consequently release the piece of food for placing on the tongue. This resilient-elastic capacity is achieved in that the eating implement tong web connecting the tong arms is constructed as a resilient-elastic element, or in that the relatively long tong members in the case of a corresponding material selection have an adequate spring-elastic capacity and can be automatically returned from a slightly downwardly bent position to their initial position. The length of the tong members of the eating implement can roughly correspond to the length of the known oriental chopsticks, but can also be made shorter. The shorter construction has the advantage that the pieces of food can be taken up by the two tong members in the same way as a fork and then guided to the mouth.

Due to the fact that the free ends of the tong members are pointed, it is also possible to impale pieces of food and supply same to the mouth in this way. However, the possibility also exists to impale a piece of food with one of the two tong members and during the taking up and guiding to the mouth of this impaled piece of food, an additional clamping and holding action can be exerted thereon by pressing together the two tong members.

A particular advantageous construction of the eating implement is obtained if the tong members are bent in a slightly arcuate manner, so that the tong web comes to rest in roughly one plane with the free ends of the tong members. As a result of this shape of the tong-like shaped eating implement, the form of the conventional fork is attained.

Due to the fact that each tong member of the eating implement has a square or rectangular cross-sectional profile, the tong members acquire a high inherent rigidity and are prevented from deforming, e.g. buckling, even if the tong members and web are made from the same material, the actual tong web having resilient-elastic characteristics.

Due to the fact that it is possible to vary the length of the tong legs of the eating implement, it is possible to bring the eating implement to a size suitable for children, so that it can be used both by adults and children.

By the provision of a thumb contact or engagement surface and finger contact or engagement surfaces on the outer wall faces of the tong legs of the eating implement or by the construction of the tong member outer wall faces with a gripping profile, it is ensured that the eating implement can be securely held in the hand without slipping.

Advantageous developments of the invention are characterized in the subclaims.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
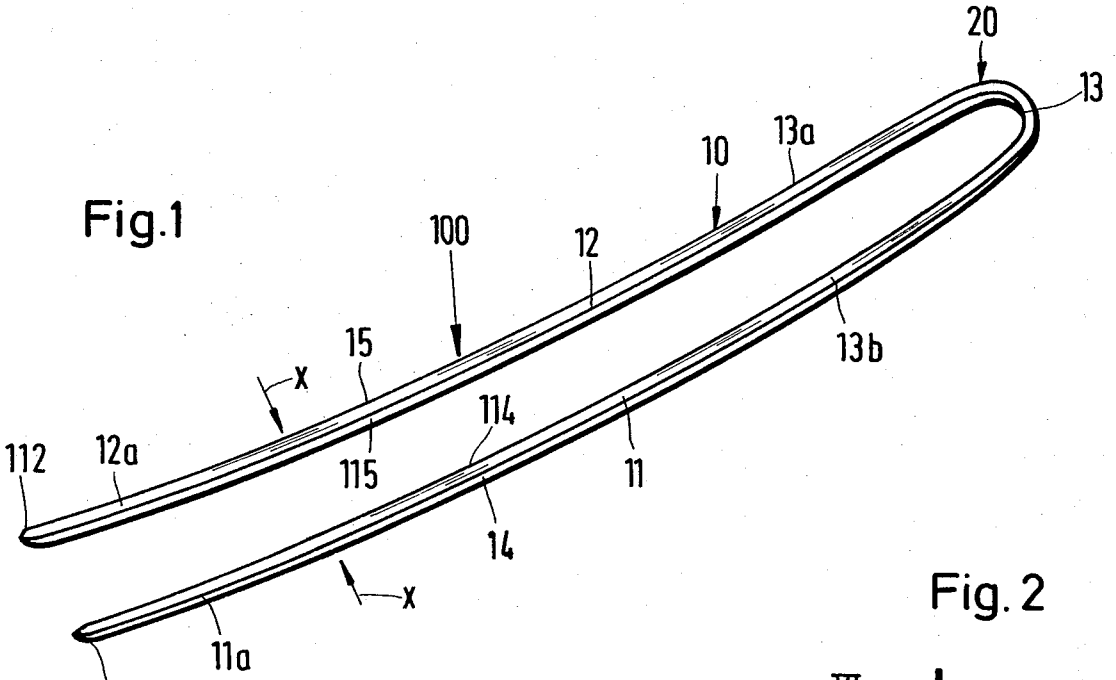
FIG. 1 the eating implement comprising a tong-like shaped member in a diagrammatic view.
Figure 2:
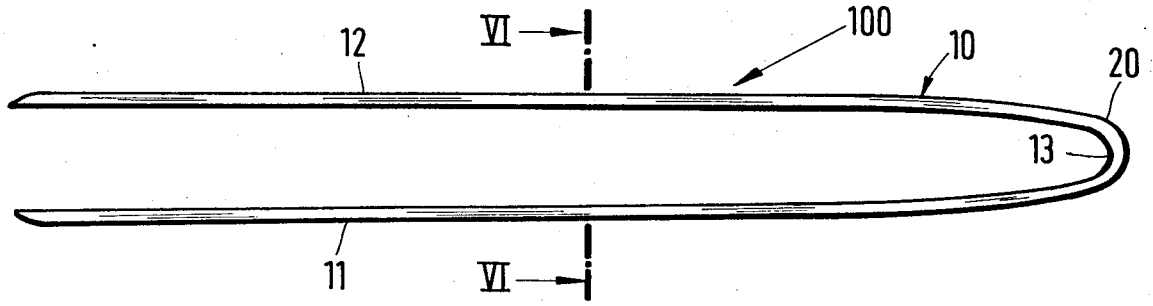
FIG. 2 the eating implement in a view from above.
Figure 3:
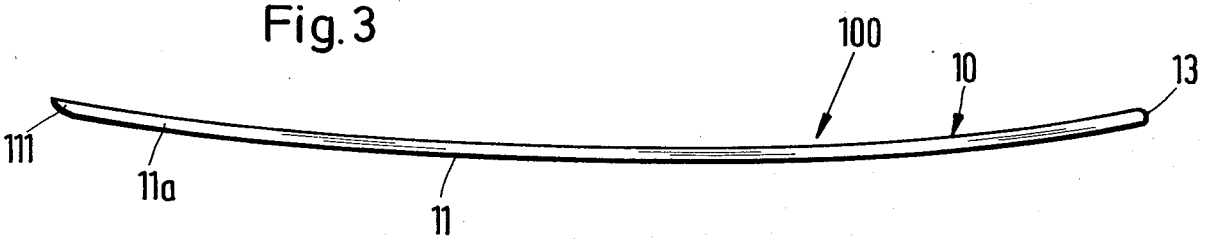
FIG. 3 a side view of the eating implement.

The eating implement 100 in FIGS. 1 to 3 comprises a tong-like shaped body 10 with rod-like arms, sides or members 11, 12 connected by a web 13 and which are approximately parallel to one another. The tong web 13 has a roughly arcuate configuration. The two ends 11*a*, 12*a* of the two tong members 11, 12 end in a point at 111, 112, said pointed end shape of the tong members 11, 12 roughly corresponding to the end design of the fork prongs of conventional forks.

The tong members 11, 12 of the shaped body 10 are made relatively long and can have a length roughly corresponding to conventional oriental chopsticks. In the embodiment shown in FIGS. 1 to 3, the tong members 11, 12 are of roughly hand length. FIGS. 1 to 3 show the eating implement 100 in its normal size.

As can be seen from FIG. 3, the tong members 11, 12 of the shaped body 10 are curved in arcuate manner, so that tong web 13 and ends 11*a*, 12*a* of the tong members 11, 12 of the shaped body 10 are roughly located in the same plane. Thus, the eating implement 100 is shaped in such a way that it roughly corresponds to the conventional fork, the tong members 11, 12 roughly having the same function as fork prongs. As a result of the slightly curved or downwardly bent shape of the tong members 11, 12 of the shaped body 10, the eating implement can also be used in shovel-like manner for taking up pieces of food, without utilizing the clamping action of the tong members 11, 12. The pointed end design or shape of ends 11*a*, 12*a* of the two members 11, 12 makes it possible to impale pieces of food, as is the case with conventional forks.

Figure 6:
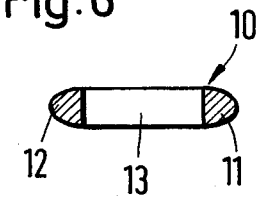
FIG. 6 a larger-scale vertical section along line VI—VI of FIG. 2.

The facing inner wall surfaces 114, 115 of the two tong members 11, 12 of the shaped body 10 are flattened, whereas the outer wall surfaces 14, 15 of the tong members 11, 12 have a semicircular or arcuate profile (FIG. 6). Otherwise the tong members 11, 12 have a square or rectangular cross-sectional profile. However, it is also possible to use cross-sectional profiles with other geometrical shapes.

The web 13 interconnecting the two tong members 11, 12 of shaped body 10 is constructed as a resilient-elastic element 20 or has a resilient-elastic element, which ensures an automatic springing back into the initial position shown in FIG. 1, if a pressure is exerted from the outside in the direction of arrows X on the two tong members 11, 12 and consequently the latter are moved against one another, so as to be able to reliably hold by means of the eating implement a taken up piece of food.

Figure 4:
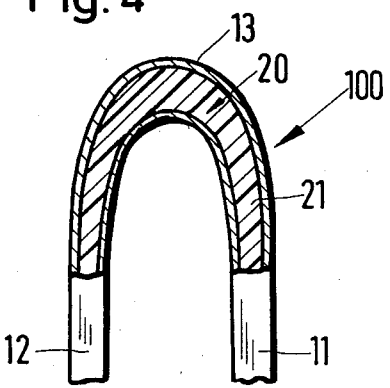

According to the embodiment of FIG. 4, the tong web 13 of shaped member 10 is constructed as a hollow body, plastic 21 being inserted as a resilient-elastic element in the inner area of tong web 13, plastic having resilient elastic characteristics with a high fatigue-free recovery capacity. For example, crosslinked polyurethane elastomer can be used as a plastic with such properties and this is commercially available under the name Vulkollan. The latter is resilient-elastic and has a high recovery capacity, so that on pressing together the tong members 11, 12 the release of pressure of the thus constructed tong web 13 leads to said members returning to their initial position.

Figure 5:
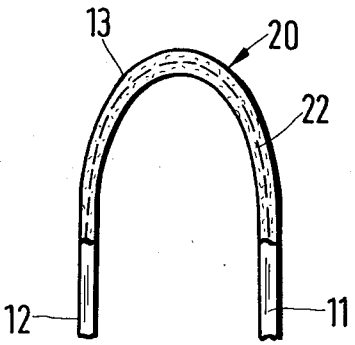
FIGS. 4 and 5 different constructions of the resilient-elastic web of the eating implement in a larger-scale sectional representation.

In the embodiment shown in FIG. 5 a prebent spring steel part 22 is embedded in the tong web 13, acting as a resilient-elastic element 20 and ensuring in the same way the necessary recovery capacity when the two tong members 11, 12 are pressed against one another and the pressure exerted thereon is removed. The use of a prebent spring steel shaped body 22 makes it possible to also produce the eating implement from materials which in themselves do not have a high elasticity and resilient recovery capacity.

The tong web 13 of shaped member 10 of eating implement 100 can also act as a resilient-elastic element in the case of a suitable material choice. The tong web 13 with its tong members 11, 12 is then made from a resilient-elastic material such as e.g. metal-enveloped plastic or a precious metal, such as silver, gold, etc, but said materials must have a certain elasticity in order to provide the necessary recovery capacity. It is important that these materials used give the tong members 11, 12 a high inherent rigidity, but it is also possible through a special cross-sectional profiling to give the tong members the necessary inherent rigidity to avoid them easily warping or deforming during the manipulation of the eating implement. Metal alloys can also be used for producing the implement.

The compressibility and automatic recovery of the tong members 11, 12 of shaped body 10 can also be achieved in such a way that the tong web with its tong members is made from a resilient-elastic material, such as metal-enveloped plastic, a precious metal or metal alloy, the tong members 11, 12 having the resilient-elastic recovery capacity in the connection region 13*a*, 13*b* of the tong web 13 (FIG. 1). This resilient-elastic design of the two tong members 11, 12 and the necessary recovery capacity for these two members can also be achieved in that e.g. a resilient-elastic bar bent corresponding to the tong-like shaped body 10 is used as an insert, said steel bar then being enveloped or coated with precious metals or corresponding metal alloys. This steel bar preferably consists of spring steel and extends over the tong web 13 and tong members 11, 12 to the ends 11*a*, 12*a* thereof.

Figure 7:
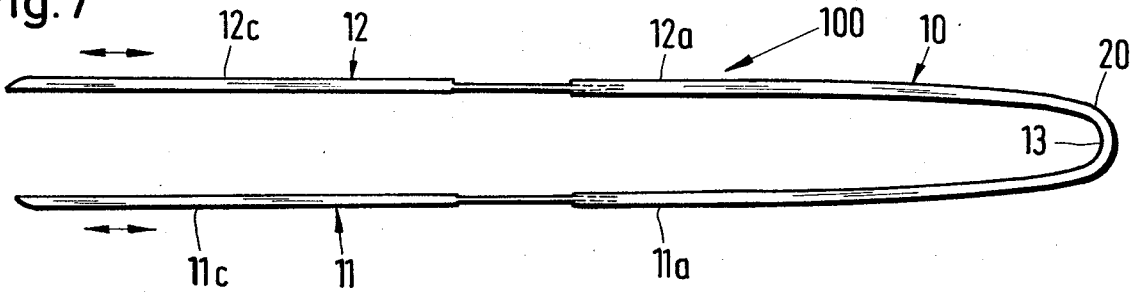
FIG. 7 the eating implement with length-variable tong members in a view from above.

In order to be able to vary at random the length of the eating implement 100, according to the embodiment of FIG. 7, the two tong members 11, 12 of shaped body 10 comprise two member portions 11*b*, 11*c* and 12*b*, 12*c*, portions 11*b*, 12*b* being interconnected via web 13, whilst the two other portions 11*c*, 12*c* are constructed in a telescopable manner. The tong member portions 11*c*, 12*c* can be fixed in the telescoped in or out position by means of suitable, per se known fixing devices, e.g. in the form of a locking profiling or a spring-loaded locking cam.

In order to improve the grip of the tong members 11, 12 of eating implement 100, the outer wall surfaces 14, 15 of members 11, 12 can be provided with a not shown gripping profile, which can e.g. be in the form of a corrugated profile.

Figure 8:
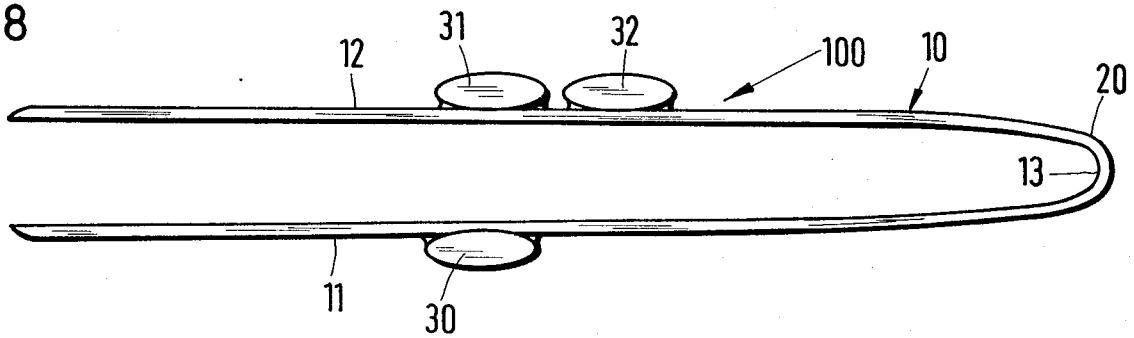
FIG. 8 the eating implement with thumb and finger engagement surfaces shaped onto its tong members in a view from above.

According to FIG. 8, the handling of the eating implement 100 can be further facilitated in that the tong members 11, 12 are provided on their outer wall surfaces 14, 15 with inwardly or outwardly projecting engagement or contact surfaces for the thumb and for at least two fingers. According to FIG. 8 the tong member 11 is provided on its outer wall surface with a plate-like thumb engagement surface 30, which can be made from the tong member material and is provided roughly centrally in member 11. The other tong member 12 has at least two successively positioned finger engagement surfaces 31, 32 on its outer wall surface 15 and roughly opposite to the thumb engagement surface 30 and said surfaces 31, 32 are shaped onto or out of the tong member material. Both the thumb engagement surface 30 and the finger engagement surfaces 31, 32 merely form enlarged engagement surfaces for the thumb and fingers, so that on taking up the eating implement 100, e.g. with the right hand, the thumb comes to rest on the engagement surface 30, whilst the index and ring fingers are supported on the two other engagement surfaces 31, 32. If said engagement surfaces 31, 32 are also profiled, i.e. they have an inwardly curved profile, then the thumb and corresponding fingers have a firm engagement on the eating implement, which can be securely held and the slipping of fingers from the same is avoided.

It is also possible to engage over or overlap the eating implement 100 during handling, so that the thumb of the right hand laterally engages over one tong member, whilst the other fingers, particularly the index and ring fingers engage over the other tong member, the surface of the hand resting on the eating implement. The eating implement can also be held in the same way as a normal fork, the underside thereof being held between the thumb and index finger and comes to rest on the first joint thereof, whilst the thumb engages over the eating implement.

What is claimed is:

1. An eating implement comprising a tong-like shaped member (10) including two rod-shaped legs (11, 12) extending approximately parallel to and spaced from one another and each having a first end and a second end with the first ends interconnected by a web (13), said web (13) being a resilient-elastic element (20) for automatically restoring said legs into the parallel position after the release of pressure displacing said legs toward one another, wherein the improvement comprises that the second ends of said legs are pointed, said legs in the direction between the first and second ends thereof have a slightly arcuate shape being bent out of a flat plane extending between the first and second ends in the manner of the curvature of fork tines, said legs having inwardly facing planar surfaces facing one another and outwardly facing rounded surfaces directed in the opposite direction, wherein said web comprises a resilient-elastic plastic part with a recovery power formed of a cross-linked polyurethane elastomer placed in the interior of the web shaped as a hollow body.

2. An eating implement comprising a tong-like shaped member (10) including two rod-shaped legs (11, 12) extending approximately parallel to and spaced from one another and each having a first end and a second end with the first ends interconnected by a web (13), said web (13) being a resilient-elastic element (20) for automatically restoring said legs into the parallel position after the release of pressure displacing said legs toward one another, wherein the improvement comprises that the second ends of said legs are pointed, said legs in the direction between the first and second ends thereof have a slightly arcuate shape being bent out of a flat plane extending between the first and second ends in the manner of the curvature of fork tines, said legs having inwardly facing planar surfaces facing one another and outwardly facing rounded surfaces directed in the opposite direction, wherein the web is formed of a resilient-elastic material comprising a precious metal.

3. An eating implement comprising a tong-like shaped member (10) including two rod-shaped legs (11, 12) extending approximately parallel to and spaced from one another and each having a first end and a second end with the first ends interconnected by a web (13), said web (13) being a resilient-elastic element (20) for automatically restoring said legs into the parallel position after the release of pressure displacing said legs toward one another, wherein the improvement comprises that the second ends of said legs are pointed, said legs in the direction between the first and second ends thereof have a slightly arcuate shape being bent out of a flat plane extending between the first and second ends in the manner of the curvature of fork tines, said legs having inwardly facing planar surfaces facing one another and outwardly facing rounded surfaces directed in the opposite direction, wherein said tong-like shaped member is provided with a flattened thumb engagement surface on one of said legs thereof with said engagement surface positioned roughly centrally between the first and second ends of said leg, and the other said leg is provided with at least two flattened finger engagement surfaces approximately opposite said thumb engagement surface.

4. An eating implement according to claims 1, 2 or 3, wherein the resilient-elastic element forming the web comprises a prebent spring steel part embedded in the web.

5. An eating implement according to claims 1, 2 or 3, wherein the web is formed of a resilient-elastic material comprising a precious metal.

6. An eating implement according to claims 1, 2 or 3, wherein the web is formed of a resilient-elastic material comprising a metal alloy.

7. An eating implement according to claims 1, 2 or 3, wherein each said leg of said tong-like shaped member comprises two telescopically insertable member portions, and means for fixing said member portions in a locked manner.

8. An eating implement according to claims 1, 2 or 3, wherein the outwardly facing rounded surfaces of each said leg is provided with a gripping profile.

* * * * *